US006196276B1

(12) United States Patent
De Laforcade

(10) Patent No.: US 6,196,276 B1
(45) Date of Patent: Mar. 6, 2001

(54) VALVE COMPONENT, VALVE, DISPENSER, AND METHOD OF FORMING A VALVE

(75) Inventor: Vincent De Laforcade, Rambouillet (FR)

(73) Assignee: L'Oréal S.A., Paris (FR)

( * ) Notice: Subject to any disclaimer, the term of this patent is extended or adjusted under 35 U.S.C. 154(b) by 0 days.

(21) Appl. No.: 09/300,851

(22) Filed: Apr. 28, 1999

(30) Foreign Application Priority Data

Apr. 28, 1998 (FR) ..... 98 05319

(51) Int. Cl.[7] ..... B65B 1/04
(52) U.S. Cl. ..... 141/20; 141/349; 222/402.1
(58) Field of Search ..... 141/20, 3, 2, 18, 141/349, 350, 353, 357; 222/402.1

(56) References Cited

U.S. PATENT DOCUMENTS

| | | | |
|---|---|---|---|
| 3,408,010 | | 10/1968 | Fukui . |
| 3,862,741 | | 1/1975 | Steiman et al. . |
| 4,944,432 | * | 7/1990 | Jouillat ..... 222/321 |
| 4,964,547 | * | 10/1990 | Lina ..... 222/385 |

FOREIGN PATENT DOCUMENTS

| | | |
|---|---|---|
| 1 166 225 | 3/1964 | (DE) . |
| 0 101 157 | 2/1984 | (EP) . |
| 0 692 434 | 1/1996 | (EP) . |
| 0 751 083 | 1/1997 | (EP) . |
| 1 228 733 | 9/1960 | (FR) . |
| 1 553 675 | 1/1969 | (FR) . |
| 2 064 449 | 7/1971 | (FR) . |
| 2 741 048 | 5/1997 | (FR) . |

OTHER PUBLICATIONS

English language Derwent Abstract of EP 0 751 083, Jan. 2, 1997.
English language Derwent Abstract of FR 2 741 048, May 16, 1997.

* cited by examiner

*Primary Examiner*—Steven O. Douglas
(74) *Attorney, Agent, or Firm*—Finnegan, Henderson, Farabow, Garrett & Dunner, L.L.P.

(57) ABSTRACT

A valve component capable of being positioned on a body of a valve includes a valving member configured to cooperate with a seal on the valve to selectively permit fluid flow through the valve when the valving member is in a first position and limit flow through the valve when the valving member is in a second position, a retainer configured to retain the seal on the valve body, and at least one frangible portion connecting the valving member to the retainer. The at least one frangible portion is configured to break when the valve component is positioned on the valve body so as to permit the retainer to retain the seal on the valve body. A valve, a dispenser, and methods of forming a valve using a valve component are also provided.

53 Claims, 8 Drawing Sheets

VALVE COMPONENT, VALVE, DISPENSER, AND METHOD OF FORMING A VALVE

Figure 1A:
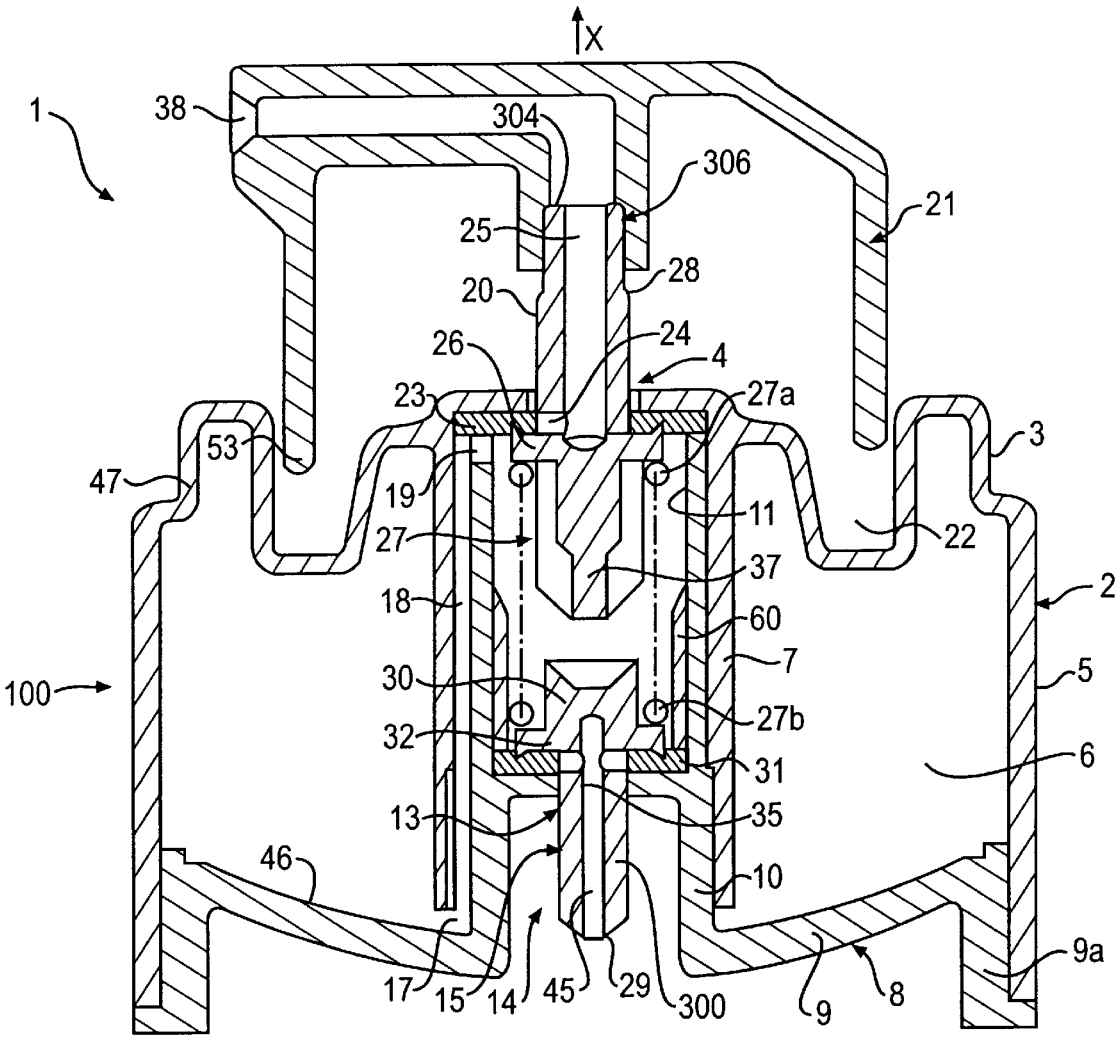

Under the provisions of 35 U.S.C. § 119, this application claims priority of French Patent Application No. 98 05319, filed Apr. 28, 1998.

The present invention relates to a valve component capable of being positioned on the body of a valve. The invention also relates to a valve for controlling fluid flow, a dispenser for containing and dispensing fluid product, and a method of forming a valve. The valve component, valve, and dispenser are preferably suited to dispense cosmetics or dermatological products in the form of at least one of a liquid jet, a mousse, a foam, a gel, or a cream.

Dispensers having a pressurized product reservoir in fluid communication with a valve are known in the art. For example, conventional dispensers of this type are described in FR-A-2,064,449 and U.S. Pat. No. 3,862,741. In addition, refillable dispensers are known in the art. For example, German patent DE-A-1,166,225 describes a reservoir of small size equipped with an outlet valve for dispensing product and an inlet valve for refilling the reservoir. Likewise, FR-A-1,228,733 describes a refillable aerosol dispenser that has a single valve for dispensing and filling.

Conventional valves that are configured to open and close the flow path of pressurized reservoirs generally include a valve housing, a valve stem, and a sealing member, such as an elastomeric washer, that all function together to selectively allow flow through the valve. The conventional valve also includes an elastic member for forcing the valve toward a closed position and an actuator for actuating the valve. The valve stem is configured to move between a first position permitting flow through a passage and a second position limiting flow through the passage. Movement of the actuator places the valve stem in the first (i.e., open) position. In one example, the actuator is a push-button configured to cause a dose of product to flow out of a reservoir and through the valve.

In the conventional valve, the sealing member is fixed on an end of the valve housing by a dish, generally made of metal. The dish is crimped or expansion rolled onto the valve housing to fix the sealing member on the valve housing. In this type of assembly, the sealing member is sandwiched tightly between an end of the valve housing and the dish. The sealing member provides a seal between the inside and the outside of the valve housing. Furthermore, with the conventional configuration, a second sealing member is generally needed for fixing the dish on the reservoir.

Although the conventional valve performs adequately, the manufacturing process required to assemble the parts of the valve is complicated. In particular, to assure that the valve is properly sealed, insertion of the sealing member and the valve stem into the valve housing often requires careful alignment of the sealing member. After aligning the sealing member, the dish must be inserted and crimped or expansion rolled on the valve housing while maintaining the sealing member in the correct position. The process of aligning the sealing member and securing it to the valve housing with the dish has proved to be undesirably complicated and costly.

In light of the foregoing, there is a need in the art for an improved valve capable of simple assembly, an improved dispenser including at least one of the improved valves, and an improved method of forming a valve.

Accordingly, the present invention is directed to a valve configuration and a method of forming a valve that obviate one or more of the short-comings of the related art.

A preferred object of the present invention is to provide a valve that is simple to manufacture and does not include a metal dish requiring crimping. By eliminating the need for a metal dish, the number of parts used to make the valve and the complexity of manufacture are both advantageously reduced, while the manufacturing rate is increased.

Another preferred object of the invention is to provide a dispenser for containing and dispensing fluid product under pressure that is more simple and economical to manufacture than conventional dispensers.

Yet another preferred object of the invention is to provide a small dispensing assembly that can be used for dispensing accurate single doses of product upon each use, especially of pharmacological and dermatological products.

A further preferred object is to provide a small refillable dispenser that includes an outlet valve for dispensing product from a reservoir and an inlet valve for filling the reservoir with fluid product, wherein at least one of the valves is of a simplified construction.

It should be understood that the invention could still be practiced without performing one or more of the preferred objects and/or advantages set forth above. Still other objects will become apparent after reading the following description of the invention.

To achieve these and other advantages, and in accordance with the purposes of the invention, as embodied and broadly described herein, the invention includes a valve component capable of being positioned on a body of a valve. The valve component includes a valving member configured to cooperate with a seal on the valve to selectively permit fluid to flow through the valve when the valving member is in a first position and limit flow through the valve when the valving member is in a second position. The valve component also includes a retainer configured to retain the seal on the valve body. At least one frangible portion connects the valving member to the retainer. The at least one frangible portion is configured to break when the valve component is positioned on the valve body so as to permit the retainer to retain the seal on the valve body.

This preferred configuration preferably makes it possible to substantially reduce the cost of producing valves. In particular, the valve component described above simplifies the way in which the seal is positioned in the valve body. This simplification of manufacture also assures more accurate alignment of the seal on the valve body, thereby improving the operation of the valve.

In another aspect, the valving member includes a stem having a duct including a first orifice and at least one second orifice for permitting fluid to flow to and from the duct. The first orifice is preferably configured to direct fluid flow into the duct in a direction parallel to a longitudinal axis of the stem and the at least one second orifice is preferably configured to direct flow away from the duct in a radial direction substantially perpendicular to the longitudinal axis of the stem.

In a further aspect, the valving member includes a cupped portion capable of receiving at least a portion of a male member for actuating the valve.

In another aspect, the retainer is a tubular element, for example, a length of tubing or a ring.

In a further aspect, the valving member is at least substantially coaxial with the retainer.

In yet another aspect, the at least one frangible portion includes a plurality of breakable members arranged radially about the valving member. Preferably, the breakable members are broken as the valve is assembled.

In still another aspect, the valving member includes a shoulder extending therefrom, a bottom surface of the shoulder being configured to contact the seal when the valving member is in the second position. The frangible portion connects the valving member and the retainer so that a bottom of the retainer is above the bottom surface of the shoulder before the frangible portion is broken.

In another aspect, the invention includes a valve for controlling fluid flow. The valve includes a valve body and the valve component described above.

In a further aspect, the valve includes a seal on the valve body configured to cooperate with the valving member, wherein the retainer retains the seal on the valve body. The seal is preferably an elastomeric washer produced by stamping an elastomeric sheet.

In an additional aspect, the valving member preferably includes a stem and the seal is preferably a ring or elastomeric washer positioned around the stem.

In another aspect, the stem includes a duct having at least one orifice arranged radially on the stem so that the seal blocks passage of fluid through the at least one orifice when the valving member is in the second position.

In still another aspect, the valve includes a biasing member biasing the valving member toward the second (i.e., closed) position. The biasing member is preferably a spring.

In yet another aspect, the retainer is press fit in an inner region of the valve body.

In another aspect, the invention includes a dispenser for containing and dispensing fluid product. The dispenser includes a product reservoir capable of containing the fluid product and one of the valves described above. The valve selectively allows at least one of flow of the fluid product into the product reservoir and flow of the fluid product from the reservoir. The product reservoir preferably contains a pressurized amount of the fluid product. The dispenser preferably includes an actuator for moving the valving member to the first position.

In a further aspect, the dispenser includes an inlet (i.e., refilling) valve positioned on the reservoir for selectively allowing flow of the fluid product into the reservoir and an outlet (i.e., dispensing) valve positioned on the reservoir for selectively allowing flow of the fluid product from the reservoir. The dispenser preferably includes a push-button mounted on the outlet valve to selectively actuate the outlet valve to dispense product. The push-button preferably includes a diffuser, such as a grating, a porous dome, or a spray nozzle. The inlet valve is preferably configured to be placed in flow communication with a container containing an amount of fluid product for filling and/or refilling the reservoir. Preferably, at least one of the inlet and outlet valves includes one of the valve components described above, wherein the frangible portion is broken during positioning of the valve component.

In another aspect, the dispenser includes an actuator for actuating the outlet valve to allow flow of the fluid product from the reservoir. The actuator is preferably a push-button having a dispensing nozzle.

In yet another aspect, the inlet valve faces away from the outlet valve and the inlet and outlet valves are at least substantially aligned.

In a further aspect, the dispenser includes a biasing member for biasing each of the inlet and the outlet valves toward a respective closed position. The biasing member is preferably a spring.

The preferred dispenser includes two independently actuated valves that are easy to manufacture and have an economical production cost.

In another aspect, the outlet valve includes a valve stem that is configured to be tilted in a sideways direction to place the outlet valve in an open position. In an alternate embodiment, the valve stem is configured to be pushed in an axial direction to place the outlet valve in the open position.

In a further aspect, the valving member includes a cupped portion capable of receiving a refilling stem from a refilling container. The refilling stem is preferably an integral part of the refilling container. The configuration of the valving member for this embodiment helps to prevent accidental actuation of the inlet valve.

In another aspect, the dispenser includes a housing having a top portion and a bottom portion defining the reservoir and the valve body. The outlet valve is preferably provided on the top portion and the inlet valve is preferably provided on the bottom portion. The top and bottom portions of the dispenser are preferably sealingly connected by welding, snap-fastening, screwing, bonding, or any other appropriate means.

The valve body is preferably a constituent element of both the inlet valve and the outlet valve. This configuration advantageously limits the number of parts and the size of the assembly since the inlet and outlet valves share a common valve body. In addition, having a single valve body reduces the cost of manufacturing the dispenser and provides for simple assembly.

In yet another aspect, the valving member of the outlet valve includes an outlet stem having a first end extending in the valve body and a second end extending from the valve body. The valving member of the inlet valve includes an inlet stem having a first end extending in the valve body and a second end extending from the valve body. The inlet stem preferably has an external portion including the second end of the inlet stem. The bottom portion of the housing preferably has a recess for receiving the external portion. Preferably, the height of the recess is greater than the height of the external portion. The first end of the inlet stem is preferably substantially opposite to the first end of the outlet stem. The dispenser also includes a biasing member, such as a spring, cooperating with the first end of the outlet stem and the first end of the inlet stem.

In a further aspect, the inlet valve includes an inlet stem and a seal arranged around the inlet stem and extending from the inlet stem to a side portion of the valve body. The retainer retains the seal in contact with a lower portion of the valve body and is initially positioned with the assistance of the frangible portion described above. A first portion of the inlet stem has a shoulder including a surface facing the seal and a sealing rim on the surface. The surface of the shoulder contacts the seal and the sealing rim bites into the seal when the inlet valve is in the closed position to prevent fluid from flowing through the inlet valve. The surface and the sealing rim are biased toward the seal by a biasing member, such as a spring.

In another aspect, the top portion of the housing includes a first transverse wall that forms an upper portion of the valve body and supports the outlet valve, a first transverse skirt that defines an external portion of the reservoir, and a first hollow shaft that defines an internal portion of the reservoir. The bottom portion includes a second transverse wall that forms the lower portion of the valve body, a second lateral skirt coupled to the first lateral skirt for attaching the bottom portion to the top portion, and a second hollow shaft having an outer diameter smaller than an inner diameter of the first hollow shaft and forming a side portion of the valve body. At least one of the top and bottom portions is configured so that the reservoir and the valve body fluidly communicate with one another. Preferably, an end of the second hollow shaft is attached to the second transverse wall and the first shaft is slightly above the second transverse wall.

In still another aspect, the first transverse wall includes an annular groove between the first lateral skirt and the first hollow shaft for accommodating a portion of the actuator.

In another aspect, the second transverse wall has a concave profile that faces toward an interior of the reservoir and is between the second lateral skirt and the second hollow shaft. This feature allows the reservoir to be more fully emptied.

The first end of the outlet stem preferably defines an axial stop limiting movement of the inlet stem when the inlet valve is moved toward an open position during filling and/or refilling of the reservoir. The second end of the inlet stem is preferably configured to cooperate with a refilling container. For example, the second end of the inlet stem may have a frustoconical profile.

Preferably, the product within the reservoir is pressurized to facilitate dispensing of the product. For example, the product may be pressurized by including in the reservoir a liquefiable propellant that is at least partially soluble in the product or a nonliquefiable gas. The product may also be pressurized by including in the reservoir a member made of closed-cell cellular material or by providing the reservoir with pressurized gas separated from the product by a pressurizing element, such as a piston, bag, or other suitable element.

In another aspect, the invention includes a method of forming a valve from a valve body, a seal, and a valve component. The valve component includes a valve member, a retainer, and a frangible portion connecting the valve member to the retainer. The method includes positioning the seal and the valve component in the valve body so that the seal is between the valve component and an end portion of the valve body. Then, force is applied to the valve component sufficient to break the frangible portion and separate the valve member and the retainer. After the frangible portion breaks, the retainer is moved to a position in which the retainer retains the seal on the end portion of the valve body. Preferably, the applying of force to the valve component includes applying force to the retainer. The force is preferably applied with an insertion tool.

In yet another aspect, the method includes positioning a biasing member in the valve body so that the biasing member biases the valving member toward the end portion of the valve body.

In still another aspect, the retainer and valve body are cylindrically shaped and the retainer has an outer diameter of approximately the same size as the inner diameter of the valve body. The method includes applying force to the retainer to force fit the retainer in the valve body.

In another aspect, the invention includes a valve manufactured by one of the above methods.

Besides the structural arrangements set forth above, the invention could include a number of other arrangements, such as those explained hereinafter. It is to be understood that both the foregoing general description and the following detailed description are exemplary, and are intended to provide further explanation of the invention as claimed.

Figure 1B:
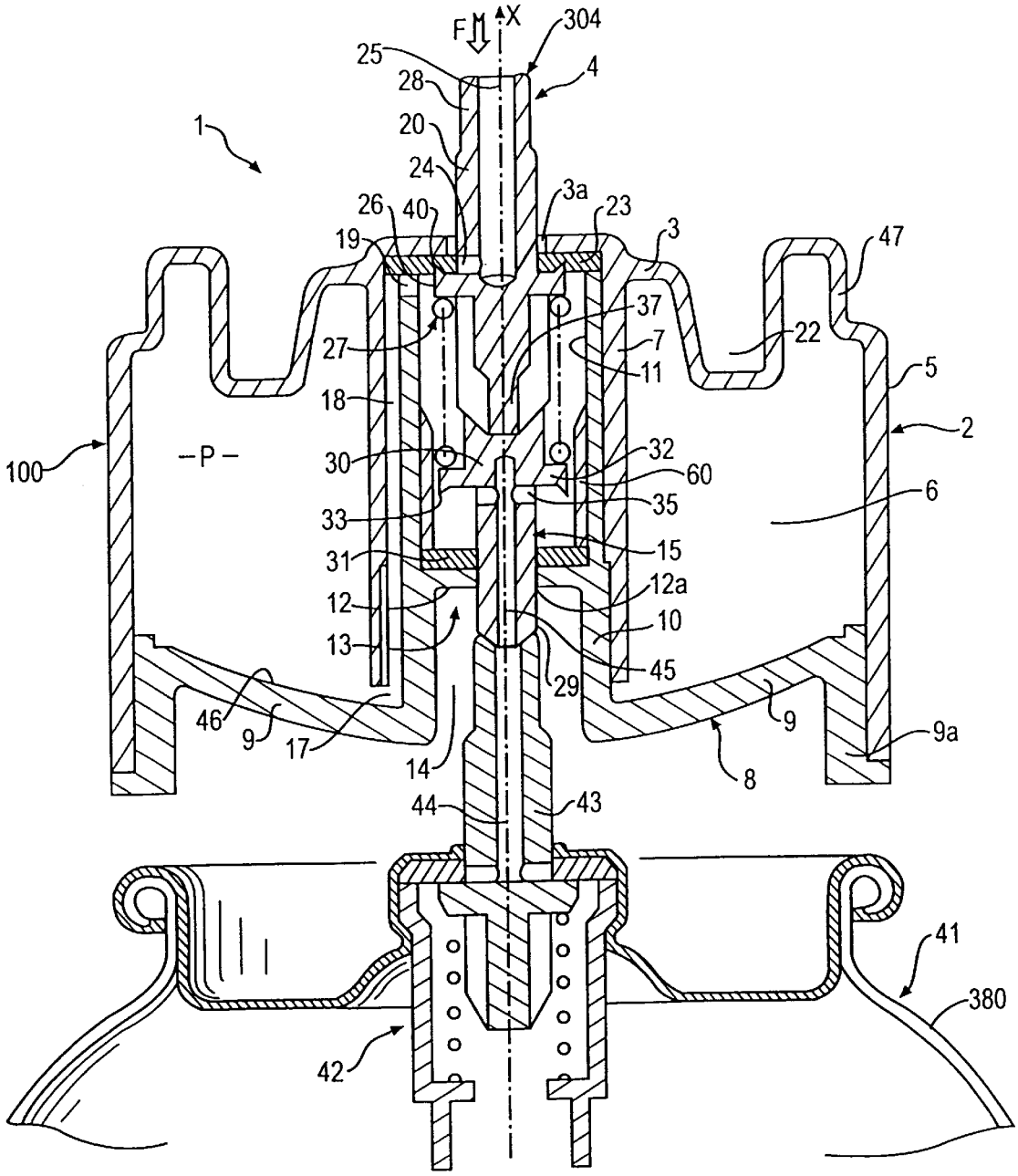
Figure 1C:
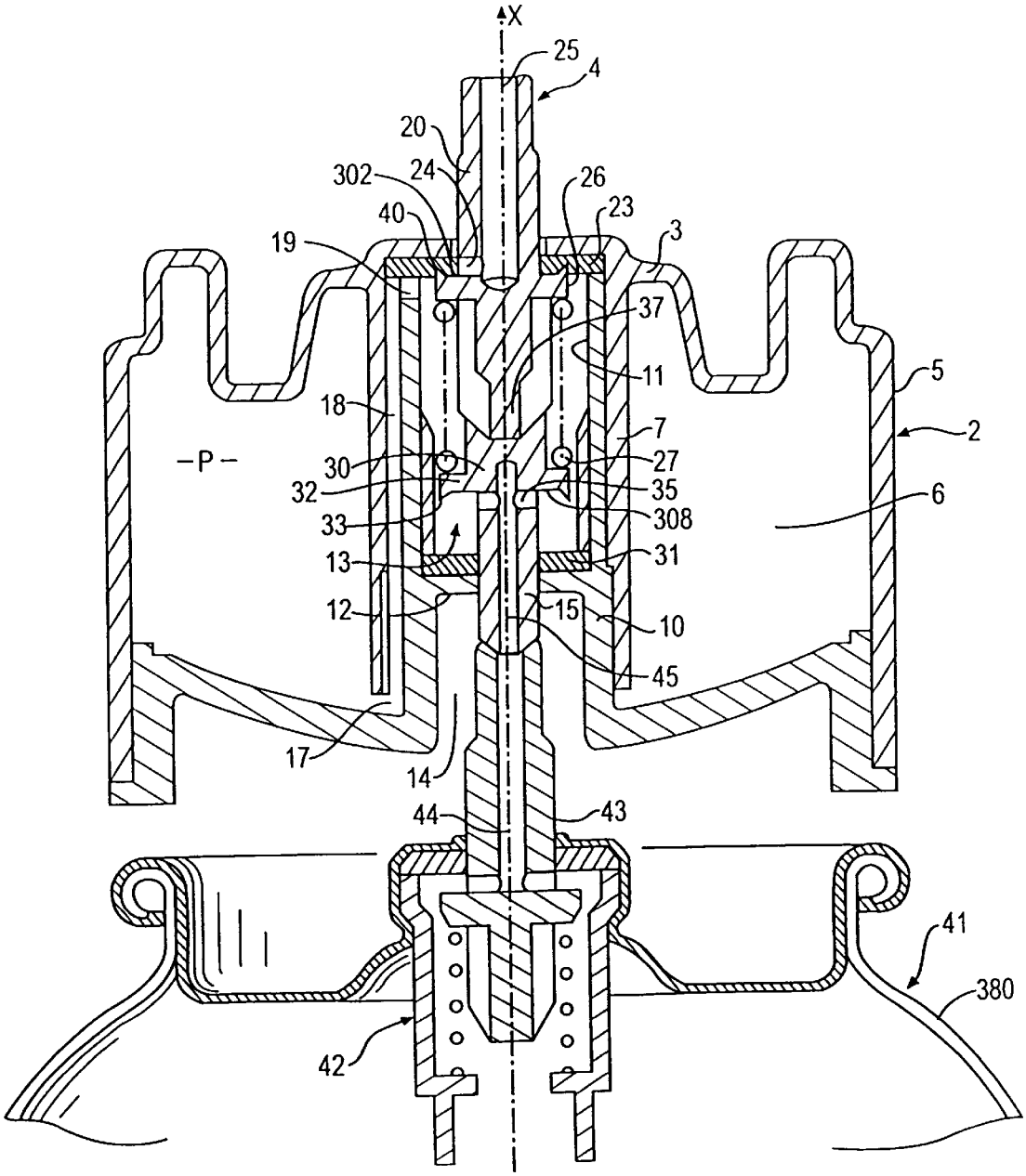
Figure 2:
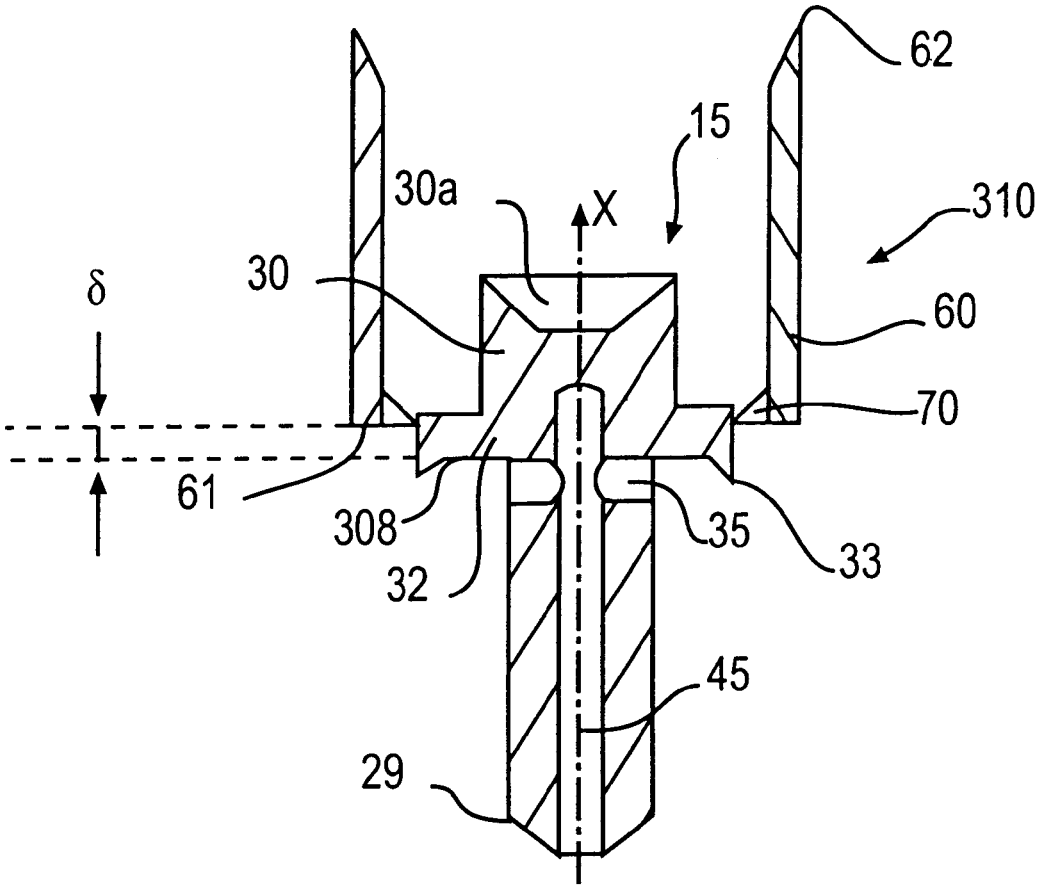

The accompanying drawings are included to provide a further understanding of the invention and are incorporated in and constitute a part of this specification. The drawings illustrate embodiments of the invention and, together with the description, serve to explain the principles of the invention. In the drawings, FIG. 1*a* is a cross-sectional view of an embodiment of a dispenser including an inlet valve and an outlet valve;

FIG. 1*b* is a cross-sectional view of the dispenser of FIG. 1*a* and a portion of a refilling container before the dispenser is refilled by the refilling container;

FIG. 1*c* is a cross-sectional view similar to FIG. 1*b* showing refilling of the dispenser;

FIG. 2 is a cross-sectional view of a male-type valve component for a valve on the dispenser of FIG. 1*a;*

Figure 3A:
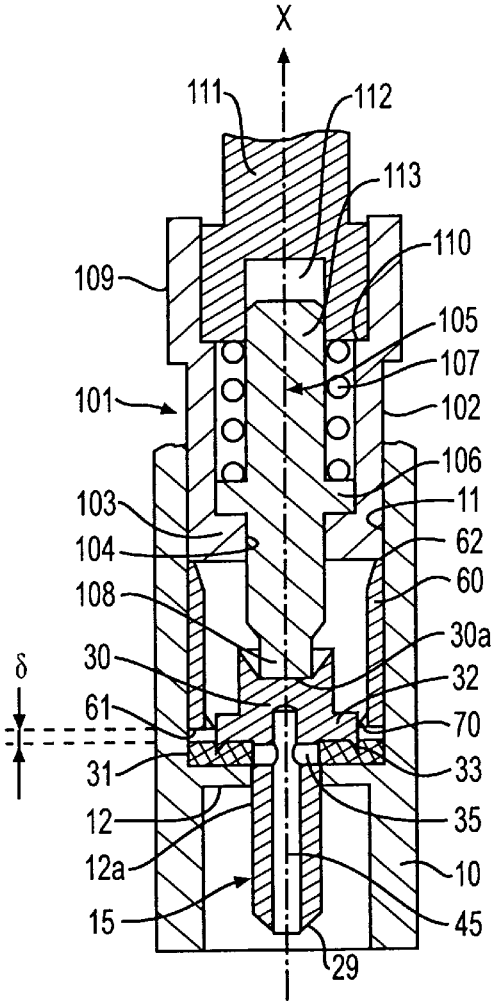
Figure 3B:
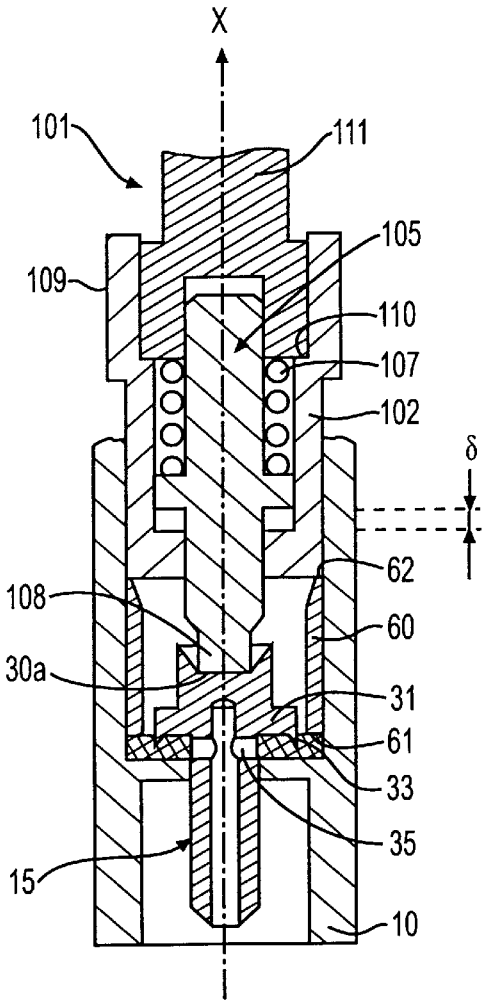
Figure 4A:
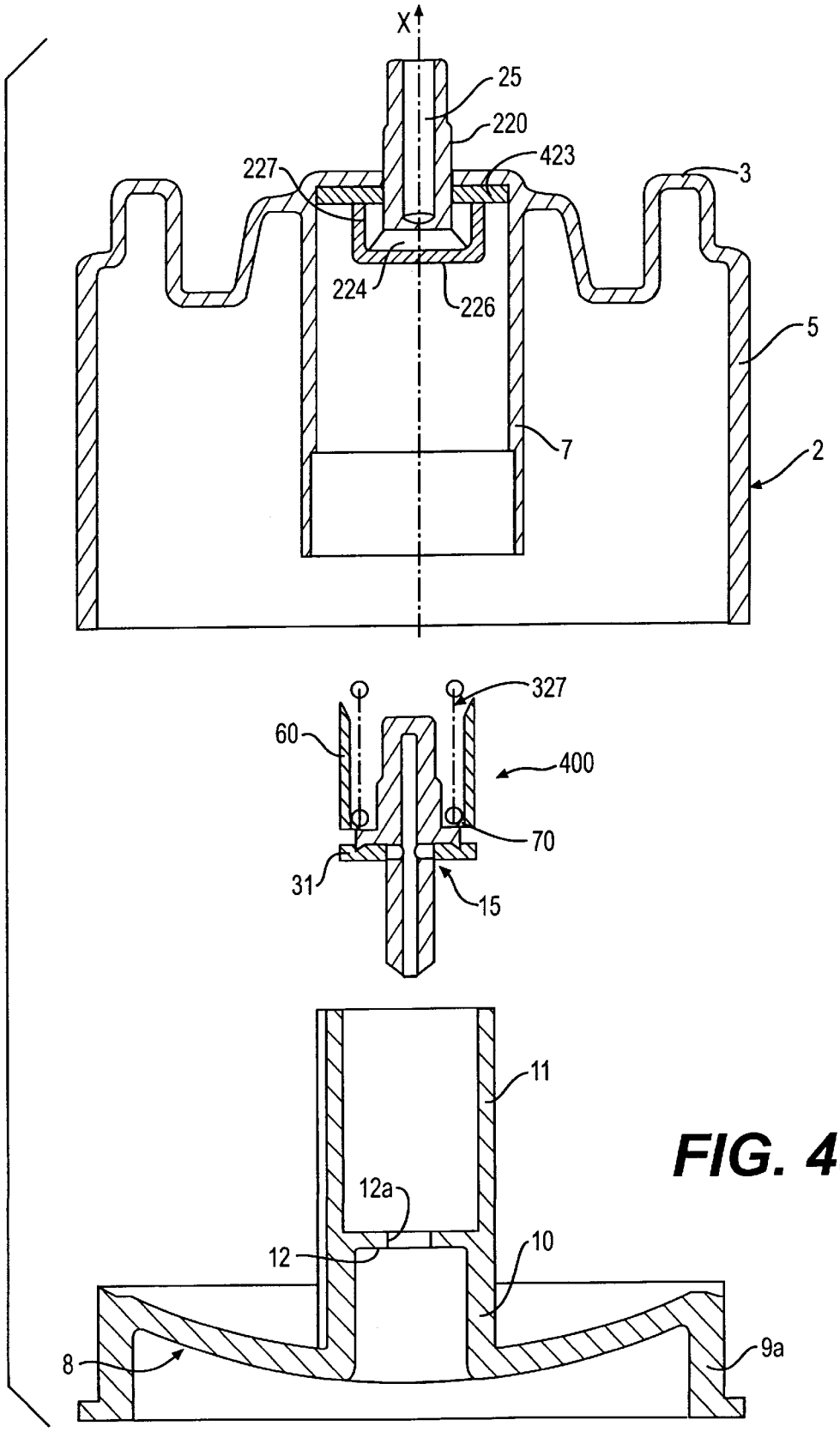
Figure 4B:
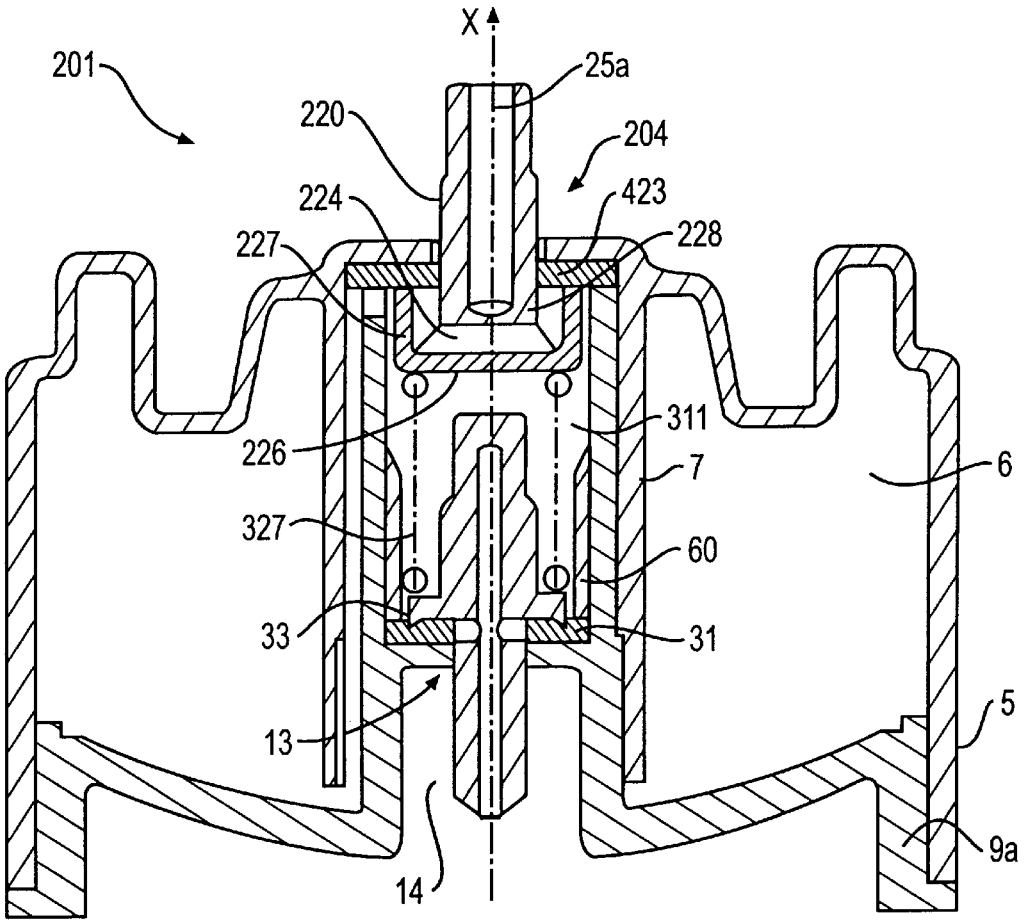
Figure 5:
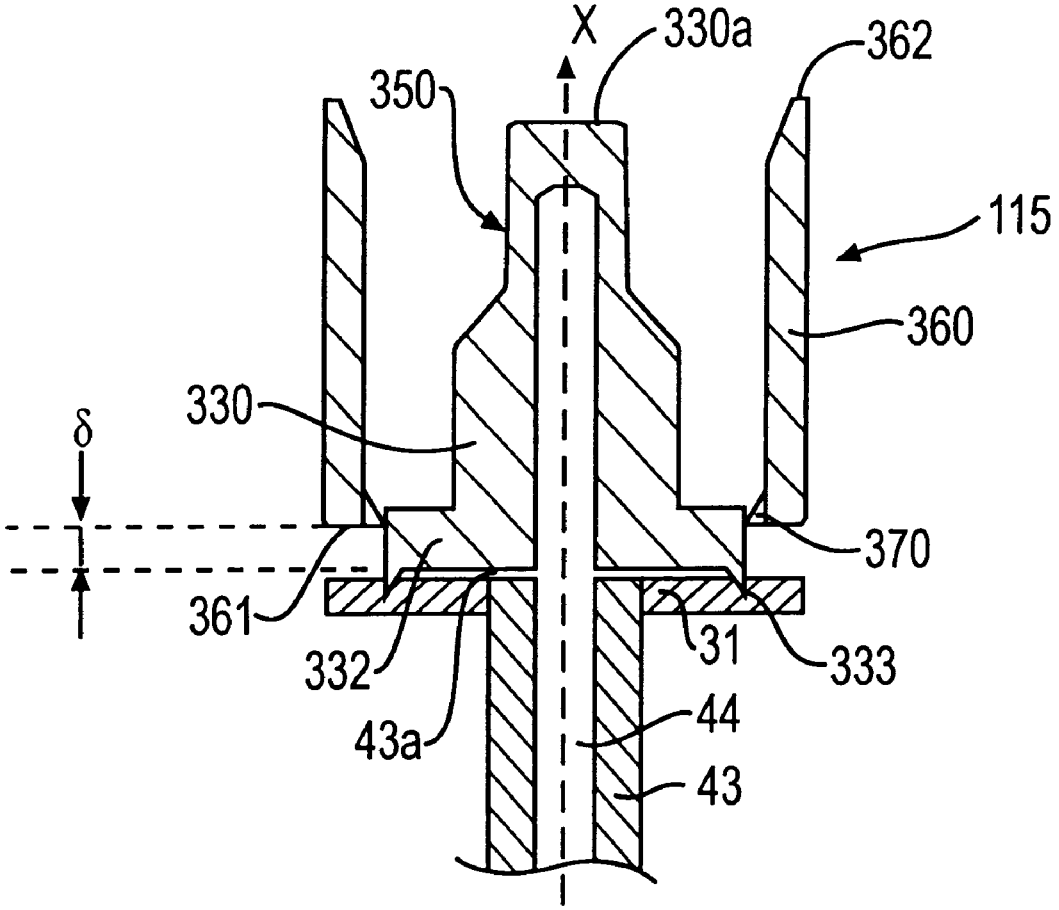

FIGS. 3*a* and 3*b* are cross-sectional views showing the positioning of the valve component of FIG. 2 in a valve body;

FIGS. 4*a* and 4*b* are cross-sectional views showing a second embodiment of a valve component in an inlet valve of a second embodiment of the dispenser; and FIG. 5 is a cross-sectional view of a female-type valve component along with a valve seal and portion of a stem for a refilling container.

Reference will now be made in detail to the present preferred embodiments of the invention, examples of which are illustrated in the accompanying drawings. Wherever possible, the same reference numbers are used in the drawings and the description to refer to the same or like parts.

Referring to FIGS. 1*a*, 1*b*, and 1*c*, a dispenser 1 includes a housing 100 forming a reservoir 6 capable of holding a pressurized product P and a valve body 11 for supporting an inlet valve 13 and an outlet valve 4. The valve body 11 is a constituent element of both the inlet valve 13 and the outlet valve 4. The inlet and outlet valves 13, 4 allow product to respectively flow in and out of the reservoir 6. The housing 100 has a longitudinal axis X and is generally cylindrically shaped. The housing 100 includes a top portion 2 and a bottom portion 8. The top portion 2 includes a first transverse wall 3 forming an upper portion of the valve body 11 and supporting the outlet valve 4. A first lateral skirt 5 extends from the first transverse wall 3 and defines an external portion of the reservoir 6. The first lateral skirt 5 forms an annular recess 47 for attaching a removable cap (not depicted) by snap-fitting, for example. A first hollow shaft 7 extends from the first transverse wall 3 in a direction substantially centered about the longitudinal axis X and defines an internal portion of the reservoir 6.

The bottom portion 8 includes a second transverse wall 9 forming a lower portion of the valve body 11 and supporting the inlet valve 13. A second lateral skirt 9*a* extends downwardly from the second transverse wall 9 and has an external profile capable of cooperating with the internal profile of the first transverse wall 5. A second hollow shaft 10 extends upwardly from the second transverse wall 9 and forms side portions of the valve body 11. Preferably, the inside diameter of the first hollow shaft 7 is slightly larger than the inside diameter of the second hollow shaft 10, and the shafts 7, 10 are substantially concentric. A middle portion 12 of the second lateral wall 9 extends within the second hollow shaft 10 forming a bottom portion of the valve body 11. Between the second lateral skirt 9*a* and the second hollow shaft 10, the second transverse wall 9 has a concave portion 46 facing toward an interior of the reservoir 6. The concave portion 46 allows the reservoir 6 to be fully emptied and to withstand greater pressure. The top portion 2 is sealingly secured to the bottom portion 8 by a conventional technique, such as welding (i.e., ultrasonic welding, mirror welding, or rotational welding), screwing or snap-fastening.

The middle portion 12 and the second hollow shaft 10 together form an axial recess 14 capable of receiving an emerging part of an inlet stem 300 (FIG. 1*a*) of a valving member 15. The recess 14 is preferably slightly taller than the height of the emerging part of the inlet stem 300, thereby preventing accidental actuation of the inlet valve 13.

An end of the second hollow shaft 10 is attached to the concave portion 46 of the second transverse wall 8 and a lower portion of the first hollow shaft 7 is slightly above the concave portion 46.

There is a chamber on the internal periphery of the first hollow shaft 7. An orifice 17 is formed by a lower part of the first hollow shaft 7, the second transverse wall 8, and the second hollow shaft 10. The orifice 17 opens into an axial groove 18 formed preferably along the entire length of the first hollow shaft 7 between the first and second hollow shafts 7, 10. Near the first transverse wall 3, the groove 18 opens into an orifice 19 passing through the second hollow shaft 10. The orifice 19 allows the reservoir 6 to fluidly communicate with the valve body 11.

The outlet valve 4 and the inlet valve 13 advantageously share a common valve body 11. The outlet valve 4 includes a valving member 306 (FIG. 1*a*) having an outlet stem 20 positioned about the axis X. The outlet stem 20 has a first end 37 extending into the valve body 11 and a second end 304 extending from the valve body 11. The outlet stem 20 extends through an opening 3*a* (FIG. 1*b*) in the first transverse wall 3.

As shown in FIG. 1*a*, a push-button actuator 21 having a dispensing orifice 38 is mounted on the second end 304 of the outlet stem 20. Preferably, the first transverse wall 3 defines an annular groove 22 between the first lateral skirt 5 and the first hollow shaft 7 for accommodating a free edge 53 of the push-button actuator 21. The depth of the annular groove 22 is preferably chosen to allow the push-button actuator 21 to move far enough in an axial direction to actuate the valving member 306 and to camouflage the lower part of the push-button actuator 21.

The outlet valve 4 includes a seal 23 for sealing the outlet valve 4 between the valving member 306 and the opening 3*a*. The seal 23 is arranged around the outlet stem 20 of the valving member 306. Preferably, the seal 23 is made of an elastomeric material. Preferably, the seal 23 has an outside diameter substantially equal to the inside diameter of the first hollow shaft 7 and is held against the first transverse wall 3 by the annular upper edge of the second hollow shaft 10. The outlet stem 20 has at least one radial passage 24 opening into an internal axial dispensing duct 25. As shown in FIG. 1*c*, a portion of the outlet stem 20 inside the valve body 11 has a shoulder 26 including a surface 302 facing the seal 23 and a sealing rim 40 on the surface 302. The surface 302 of the shoulder 26 contacts the seal 23 and the sealing rim 40 bites into the seal 23 when the outlet valve 4 is in the closed position to prevent fluid from flowing through the outlet valve 4. The surface of the shoulder 26 opposite to the surface 302 forms a bearing surface for a first end 27*a* (FIG. 1*a* ) of a biasing member 27 for biasing the shoulder 26 against the seal 23. The biasing member 27 is preferably a spring. When the inlet valve 4 is in the closed position, the at least one radial passage 24 is blocked by the seal 23 and the dispensing duct 25 is not in fluid communication with the valve body 11 and the reservoir 6. Pressing the push button actuator 21 forces the outlet stem 20 into the valve body 11 and thereby places the passage 24 in communication with the valve body 11 and reservoir 6 to place the outlet valve 4 in an open position.

Referring to FIG. 1*a*, the inlet valve 13 includes a seal 31 for sealing the inlet valve 13. The seal 31 is arranged about the inlet stem 300 (FIG. 1*a*) of the valving member 15. The inlet stem 300 has a first end 30 that extends in the valve body 11 and a second end 29 that extends from the valve body 11 through an opening 12*a* formed in the middle portion 12. The inlet stem 300 is positioned inside of the valve body 11 along the longitudinal axis X of the dispenser 1 and faces away from the valve stem 20. The valve stems 20, 300 are preferably aligned about the axis X. The inlet stem 300 has at least one radial passage 35 opening into an internal axial duct 45. A portion of the inlet stem 300 inside of the valve body 11 has a shoulder 32 including a surface 308 (FIG. 1*c*) facing the seal 31 and a sealing rim 33 on the surface 308. The surface 308 contacts the seal 31 and the sealing rim 33 bites into the seal 31 when the inlet valve 13 is in the closed position to prevent fluid from flowing through the inlet valve 13.

The seal 31 is held against the bottom portion of the valve body 11 (formed by the middle portion 12) by a retainer 60. The retainer 60 is preferably a tubular element, for example, a length of tubing or a ring. The retainer 60 is positioned in the valve body 11 so that a lower end of the retainer contacts an upper face of the seal 31. Preferably, the outlet diameter of the retainer 60 is substantially the same as the inner diameter of the valve body 11 to enable press-fitting of the retainer 60 in the valve body 11. The surface of the shoulder 32 opposite to the surface 308 forms a bearing surface for a second end 27*b* (FIG. 1*a*) of the biasing member 27. Although the embodiment of FIGS. 1*a*, 1*b*, and 1*c* has the retainer 60 press-fit in the valve body 11, one of ordinary skill in the art would appreciate that the retainer 60 could be held in place by other means, such as snap-fastening, bonding, or welding.

The biasing member 27 biases both the valving member 306 and the valving member 15 toward their closed positions. Having a single biasing member 27 for both of the valves 4, 13 advantageously reduces the number of parts required and the manufacturing costs.

Referring to FIG. 1*a*, the first end 37 of the outlet stem 20 preferably forms a stop for the first end 30 of the inlet stem 300 to limit travel of the valving member 15 during refilling of the reservoir 6 via inlet valve 13. Likewise, the first end 30 of the inlet stem 300 forms a stop for the first end 37 of the outlet stem 30 to limit travel of the valving member 306 when the product is dispensed via outlet valve 4. Preferably, the first end 30 of the inlet stem 300 has a dished surface 30*a*, as shown in FIG. 2, to accommodate the first end 37 of the outlet stem 20.

The outlet valve 4 is actuated by depressing the push-button actuator 21 to move the valving member 306 axially along the longitudinal axis X. As the valving member 306 moves axially, the radial passage 24 is placed in fluid communication with the valve body 11 and the reservoir 6, allowing product to flow through the internal duct 25 of the outlet stem 20 and the outlet 38 of the push-button 21. When the push-button 21 is released, the biasing member 27 biases the shoulder 26 against the seal 23, closing the radial passage 24 with the seal 23 and limiting flow through the outlet valve 4.

The dispenser 1 described above is preferably used with the outlet stem 20 pointing up and is particulary suited for dispensing lacquer, hair lotion, or scent.

As shown in FIGS. 1*b* and 1*c*, when the contents of the reservoir 6 have been exhausted, a user preferably refills the reservoir 6 with additional product by using a refilling container 41. The refilling container 41 is preferably pressurized and includes a refilling reservoir 380 having a valve 42 crimped to the top of the reservoir 380. The valve 42 includes a refilling stem 43 including an internal duct 44 with an outlet having a diameter slightly greater than the diameter of the second end 29 of the inlet stem 300. Preferably, the second end 29 has a frustoconical profile to encourage sealing cooperation between inlet stem 300 and the refilling stem 43.

By placing the inlet stem 300 of the dispenser 1 on the refilling stem 43 and exerting an axial force on the dispenser 1 in the direction of the arrow F (FIG. 1*b*), the valving member 15 moves axially inward in the valve body 11 and the radial passage 35 is uncovered from the seal 31. In the open position, the valve body 11 and the reservoir 6 are allowed to fluidly communicate with the refilling container 41. The pressurized product contained in the refilling reservoir 41 rises up the duct 44 of the refilling stem 43 and is transferred to the internal duct 45 of the inlet stem 300 and into the reservoir 6 via the radial passages 35. The fluid then moves through the inside of the valve body 11 into the orifice 19, through the groove 18, through the orifice 17, and into the reservoir 6. Transfer of product from the refilling container 41 preferably continues until the pressures in the refilling reservoir 308 and the dispenser 1 reach equilibrium. When the inlet valve 13 is allowed to return to the closed position, the radial passages 35 are covered by the seal 31 to close the inlet valve 13. The sealing rim 33 further assures a tight seal by biting into the seal 31. During refilling of the dispenser 1, the seal 31 prevents fluid from flowing between the seal 31 and the valving member 15. Once refilled, the dispenser 1 can be used again as described above.

Preferably, the top and bottom portions 2, 8 of the housing 100 are made of thermoplatic materials that are physically and chemically compatible, so that they can be welded together. For example, materials for the top and bottom portions 2, 8 may be chosen from the family of polyolefins, such as polypropylene, polyethylene, and ethylene-propylene copolymers, the family of polyacetals, such as polyoxyethylene, polyethylene, terephthalate, and polymethyl methacr1late. More preferably, to assure impermeability and compatibility with the product dispensed, the top and bottom portions 2, 8 are made of polybutylene terephthalate.

In one embodiment, the product is pressurized using a liquefiable gas, a compressed gas, or a piston mounted on an elastically-compressible means. The gas may be a single gas or a mixture of gases that can be compressed or liquefied at the pressures used.

In an alternate embodiment, the product is pressurized using a block of closed-cell cellular foam in the form of an annulus arranged in the reservoir 6. The foam is preferably positioned into the reservoir 6 before the bottom is mounted on the body around the first hollow shaft 7. When the reservoir 6 is filled with product, the annulus of foam compresses in all directions, thereby allowing the product in the reservoir to be pressurized. The annulus of foam is preferably slit along its entire height. By way of example, the foam is made of a "plastazote" (foam made with polyolefin and gas consisting of nitrogen), rubber, such as nitrile (BUNA) and neoprene, or silicone.

The pressurizing techniques introduced above are described in more detail in FR-A-2,741,048, which is incorporated herein by reference.

Referring to FIG. 2, to facilitate the manufacture of the valve 13 in the dispenser 1, a valve component 310 is provided, comprising the valving member 15, the retainer 60, and one or more frangible portions 70 connecting the valving member 15 to the retainer 60. Preferably, the frangible portions 70 extend radially outward from the valving member 15 and are uniformly distributed about the periphery of the valving member 15. The external end of each frangible portion 70 is connected to a lower portion 61 of the retainer 60. The frangible portions are configured so that the lower portion 61 of the retainer 60 is offset from the bottom of the shoulder 32 of the valving member 15 by a height δ. The frangible portions 70 are configured to break when the valve component 310 is positioned on the valve body 11 so as to permit the retainer 60 to retain the seal 31 on the valve body 11.

A preferred method for positioning the valve component 310 in the valve body 11 of the dispenser 1 is shown in FIGS. 3*a* and 3*b*. Initially, the seal 31 is placed around the inlet stem 300 of the valving member 15. Next, the valve component 310 and seal 31 are positioned on the valve body 11 so that the seal 31 is between the valve component 310 and the middle portion 12 of the valve body 11. At this point, the shoulder 32 and sealing rim 33 of the valving member 15 are in contact with the seal 31, however, the retainer 60 is offset from the seal 31 by a distance δ. Positioning the valve component 310 in the valve body 11 relative to the seal 31 is relatively simple since the valving member 15 and the retainer 60 are connected by the frangible portions 70. After positioning the valve component 310 and the seal 31 on the valve body 11, a force (i.e., an axial force) is applied to the valve component sufficient to break the frangible portions 70 and thereby separate the valving member 15 and the retainer 60. Continued application of the force moves the retainer 60 toward the seal 31 until the lower portion 61 of the retainer 60 contacts the seal 31 and retains the seal 31 against the middle portion 12.

As shown in FIGS. 3*a* and 3*b*, in one embodiment, axial force is applied to the valve component 310 using an insertion tool 101. The insertion tool 101 comprises a cylindrical portion 102 having an outside diameter slightly smaller than the inside diameter of the valve body 11. The cylindrical portion 102 is capable of resting against an upper edge 62 of the retainer 60. A lower end of the cylindrical portion 102 has a ring 103 defining an opening 104 capable of receiving a stem 105. The stem 105 has a shoulder 106 that contacts the ring 103. A helical spring 107 is provided to bias the shoulder 106 against the ring 103. The stem 105 has a lower end 108 capable of cooperating with the dished surface 30*a* of the valving member 15. The cylindrical portion 102 has an upper portion 109 having a larger diameter than the remainder of the cylindrical portion 102 and defining a shoulder part 110. A push rod 111 contacts the shoulder part 110 and has a cut-out portion 112 for receiving an upper end 113 of the stem 105. The push rod 111 maintains the spring 107 against the shoulder 106. The cut-out portion 112 receives the upper end 113 of the stem 105 when the spring 107 is compressed by an axial force applied to the push rod 111.

To position the valve component 310 and the seal 31 in the valve body 11 using the insertion tool 101, the valve component 310 and the seal 31 are inserted in an upper portion of the valve body 11. Next, the insertion tool 101 is positioned so that the lower end 108 of the stem 105 contacts the dished surface 30*a* of the valving member 15 and the ring 103 of the cylindrical portion 102 contacts the upper portion 62 of the retainer 60. The valve component 310 and the seal 31 are pushed toward the middle portion 12 of the valve body 11 with the insertion tool 101 until the seal 31 contacts the middle portion 12 and the shoulder 32 and sealing rim 33 contact the seal 31.

After positioning the valve component 310 and the seal 31 using the insertion tool 101, the frangible portions 70 are broken. The pushing rod 111 applies axial force to the ring 103 of the cylindrical portion 102. The ring 103, in turn, presses into the upper edge 62 of the retainer 60, thereby breaking the frangible portions 70. Once the frangible portions 70 are broken, the retainer 60 is press-fit into the valve body 11 by moving the lower portion 61 of the retainer 60 toward the middle portion 12 until the lower portion 61 contacts and retains the seal 31. During this last step, the stem 105 retreats a distance δ and the spring 107 is compressed, as shown in FIG. 3*b*. Thereafter, the inserting tool 101 is withdrawn from the valve body 11.

FIGS. 4*a* and 4*b* illustrate an alternate embodiment of a dispenser 201. The dispenser 201 is similar to the dispenser 1 of FIGS. 1*a*, 1*b*, and 1*c*; however, an outlet valve 204 of the dispenser 201 is actuated by a sideways movement of a stem 220 rather than axial movement. The stem 220 has an axial dispensing duct 25a opening into a radial passage 224. A first end 228 of the stem 220 is positioned inside a valve body 311 and has a circular plate 226. The circular plate 226 is surrounded by a cylindrical sealing skirt 227. The sealing skirt 227 is biased against a seal 423 by the biasing member 327. A free edge of the sealing skirt 227 sealingly contacts the seal 423 when the outlet valve 204 is in a closed position.

As illustrated in FIG. 4*a*, the dispenser 201 is formed in a manufacturing method in which a valve component 400, a seal 431, and a helical spring 327 are initially placed in the valve body 311. The valve component 400 is positioned in the valve body 311 using a method similar to the method shown in FIGS. 3*a* and 3*b* and described above. The valve stem 220 is positioned on the top portion 2 inside the first hollow shaft 7 and is held in place by the seal 423. Thereafter, the top and bottom portions 2, 8 of the housing 100 are assembled together using a conventional technique, for example, bonding or welding. When the housing 100 is assembled, an upper portion of the second hollow shaft 10 secures the seal 423 of the dispensing valve 204 against the first transverse wall 3 of the top portion 2.

FIG. 5 illustrates a second embodiment of a valve component 115 of a female type for operating a valve. The valve component 115 includes a valving member 350, a retainer 360, and one or more frangible portions 370. Compared with the valve component 15 of FIG. 2, the valving member 350 has no emerging stem and is in the form of a cup. A first end 330 of the valving member 350 extends from a shoulder 332 and is taller than the first end 30 of FIG. 2. The first end 330 has a free surface 330*a* capable of limiting the travel of the valving member 350. Similar to the embodiment of FIG. 2, the shoulder 332 has a sealing rim 333 capable of biting into the seal 332 when a biasing member (not shown) biases the sealing rim 333 against the seal 332. The seal 332 has a central opening configured so that a valve stem 43 from a refilling container can sealingly engage the valving member 350 and actuate the valve by axially moving the valving member 350 and thereby permit filling of a reservoir. The valving member 350 and the stem 43 can be engaged in a sealed way so that by moving the valving member 350 axially, it is possible to simultaneously open the inlet valve and the valve of the refill reservoir. To convey the product contained in the refill container, the free end of the stem 43 preferably has a number of crevices 43*a* that communicate fluidity with the dispenser reservoir when the valving member 350 is axially displaced.

In FIG. 5, the retainer 360 for retaining the seal 332 on the body of a valve is shown in its pre-installation state with the valving member 350 connected to the retainer 360 by one or more breakable or frangible portions 370. The valve component 115 is installed in a valve body in a manner similar to that shown in FIGS. 3*a* and 3*b*, by breaking the frangible portions 70.

It will be apparent to those skilled in the art that various modifications and variations can be made to the structure and methodology of the present invention without departing from the spirit or scope of the invention. For example, the valve component of the present invention could be used to form an outlet valve and/or an inlet valve for a dispenser. In addition, the valve component and valve of the present invention could be used in a number of different fields other than product dispensing.

In view of the foregoing, it is intended that the present invention cover modifications and variations of this invention, provided they fall within the scope of the following claims and their equivalents.

What is claimed is:

1. A valve component capable of being positioned on a body of a valve, the valve component comprising:

a valving member configured to cooperate with a seal on a valve to selectively permit fluid flow through a valve when the valving member is in a first position and limit flow through a valve when the valving member is a second position;

a retainer configured to retain the seal on a valve body; and at least one frangible portion connecting the valving member to the retainer, said at least one frangible portion being configured to break when the valve component is positioned on a valve body so as to permit the retainer to retain the seal on a valve body.

2. The valve component of claim 1, wherein the valving member includes a stem having a duct including a first orifice and at least one second orifice for permitting fluid flow to and from the duct.

3. The valve component of claim 2, wherein the first orifice is configured to direct fluid flow into the duct in a direction parallel to a longitudinal axis of the stem and said at least one second orifice is configured to direct fluid flow from the duct in a radial direction substantially perpendicular to the longitudinal axis of the stem.

4. The valve component of claim 1, wherein the valving member includes a cupped portion capable of receiving at least a portion of a male member for actuating the valve.

5. The valve component of claim 1, wherein the retainer is a tubular element.

6. The valve component of claim 5, wherein the valving member is at least substantially coaxial with the retainer.

7. The valve component of claim 5, wherein said at least one frangible portion includes a plurality of breakable members arranged radially about the valving member.

8. The valve component of claim 1, wherein the valving member includes a shoulder extending therefrom, a bottom surface of the shoulder being configured to contact the seal when the valving member is in the second position, the frangible portion connecting the valving member and the retainer so that a bottom of the retainer is above the bottom surface of the shoulder before the frangible portion is broken.

9. A valve for controlling fluid flow, the valve comprising:

a valve body;

the valve component of claim 1 positioned on the valve body with the frangible portion being broken; and a seal on the valve body configured to cooperate with the valving member, wherein the retainer retains the seal on the valve body.

10. The valve of claim 9, further comprising a biasing member biasing the valving member toward the second position.

11. The valve of claim 10, wherein the biasing member is a spring.

12. The valve of claim 9, wherein the valve body has an inner region and wherein the retainer is press fit in the inner region of the valve body.

13. The valve of claim 9, wherein the valving member includes a stem and wherein the seal is a ring positioned around the stem of the valving member.

14. The valve of claim 13, wherein the stem includes a duct having at least one orifice, said at least one orifice being radially arranged on the stem so that the seal blocks passage of fluid through said at least one orifice when the valving member is in the second position.

15. The valve of claim 9, wherein the seal is an elastomeric washer.

16. A dispenser for containing and dispensing fluid product, the dispenser comprising:

a product reservoir capable of containing the fluid product;

the valve of claim 9 positioned on the product reservoir, the valve selectively allowing at least one of flow of fluid into the product reservoir and flow of fluid from the product reservoir.

17. The dispenser of claim 16, wherein the product reservoir contains a pressurized amount of the fluid product.

18. The dispenser of claim 16, further comprising an actuator for moving the valving member to the first position.

19. A dispenser for containing and dispensing fluid product, comprising:

a reservoir capable of containing fluid product;

an inlet valve positioned on the reservoir, for selectively allowing flow of fluid into the reservoir; and an outlet valve positioned on the reservoir, for selectively allowing flow of fluid from the reservoir, wherein at least one of the inlet and outlet valves includes the valve component of claim 1 and wherein the frangible portion is broken.

20. The dispenser of claim 19, further comprising a valve body, the valve body being a constituent element of both the inlet valve and the outlet valve.

21. The dispenser of claim 20, further comprising a housing including a top portion and a bottom portion both defining the reservoir and the valve body, the outlet valve being provided on the top portion and the inlet valve being provided on the bottom portion.

22. The dispenser of claim 19, wherein the inlet valve faces away from the outlet valve and wherein the inlet and outlet valves are at least substantially aligned.

23. The dispenser of claim 21, further comprising a biasing member biasing each of the inlet and the outlet valves toward a respective closed position.

24. The dispenser of claim 23, wherein the biasing member is a spring.

25. The dispenser of claim 23, further comprising an actuator for actuating the outlet valve to allow flow of the fluid product from the reservoir.

26. The dispenser of claim 25, wherein the actuator is a push button mounted on the outlet valve.

27. The dispenser of claim 19, wherein at least the outlet valve includes a valve stem.

28. The dispenser of claim 27, wherein the valve stem is configured to be pushed in an axial direction to place the outlet valve in an open position.

29. The dispenser of claim 27, wherein the valve stem is configured to be tilted in a sideways direction to place the outlet valve in an open position.

30. The dispenser of claim 19, wherein the valving member includes a cupped portion capable of receiving an operating stem.

31. The dispenser of claim 19, wherein the inlet valve is configured to be placed in flow communication with a container containing an amount of the fluid product, for filling the reservoir.

32. The dispenser of claim 21, wherein the outlet valve includes an outlet stem having a first end extending in the valve body and a second end extending from the valve body, wherein the inlet valve includes an inlet stem having a first end extending in the valve body and a second end extending from the valve body, the first end of the inlet stem being substantially opposite to the first end of the outlet stem, and wherein the dispenser further comprises a spring cooperating with the first end of the outlet stem and the first end of the inlet stem.

33. The dispenser of claim 32, wherein the inlet stem has an external portion including the second end of the inlet stem, and wherein the bottom portion has a recess for receiving the external portion of the inlet stem, the height of the recess being greater than the height of the external portion of the inlet stem.

34. The dispenser of claim 32, wherein the second end of the inlet stem is configured to cooperate with a refilling container.

35. The dispenser of claim 24, wherein the top portion is sealingly mounted to the bottom portion by one of welding, snap-fastening, screwing, and bonding.

36. The dispenser of claim 21, wherein the top portion includes a first transverse wall forming an upper portion of the valve body and supporting the outlet valve, a first lateral skirt defining an external portion of the reservoir, and a first hollow shaft defining an internal portion of the reservoir, and wherein the bottom portion includes a second transverse wall forming a lower portion of the valve body and supporting the inlet valve, a second lateral skirt coupled to the first lateral skirt for attaching the bottom portion to the top portion, and a second hollow shaft having an outer diameter smaller than an inner diameter of the first hollow shaft and forming a side portion of the valve body, at least one of the top portion and the bottom portion being configured so that the reservoir and the valve body fluidly communicate with one another.

37. The dispenser of claim 36, wherein the inlet valve includes an inlet stem and a seal arranged around the inlet stem and extending from the inlet stem to a side portion of the valve body, the retainer retaining the seal in contact with the lower portion of the valve body, wherein a first portion of the inlet stem has a shoulder including a surface facing the seal and a sealing rim on the surface, the surface of the shoulder contacting the seal and the sealing rim biting into the seal when the inlet valve is in the closed position to prevent fluid from flowing through the inlet valve.

38. The dispenser of claim 36, wherein the dispenser further comprises an actuator for actuating the outlet valve, and wherein the first transverse wall includes an annular groove between the first lateral skirt and the first hollow shaft for accommodating a portion of the actuator.

39. The dispenser of claim 36, wherein an end of the second hollow shaft is attached to the second transverse wall of the bottom portion, the first hollow shaft being slightly above the second transverse wall of the bottom portion.

40. The dispenser of claim 36, wherein the second transverse wall has a concave profile facing toward an interior of the reservoir and being between the second lateral skirt and the second hollow shaft.

41. The dispensing container of claim 32, wherein the first end of the outlet stem defines an axial stop limiting movement of the inlet stem when the inlet valve is moved toward an open position.

42. The dispenser of claim 19, wherein the reservoir is configured to contain pressurized fluid product.

43. The dispenser of claim 42, wherein the reservoir contains at least one of closed-cell material and nonliquefiable gas for pressurizing fluid product in the reservoir.

44. The dispenser of claim 42, wherein the reservoir contains a liquefiable propellent for pressurizing fluid product in the reservoir.

45. The dispenser of claim 42, wherein the reservoir includes a pressurizing element in combination with pressurized gas for pressurizing fluid product in the reservoir.

46. The dispenser of claim 45, wherein the pressurizing element includes at least one of a piston and a bag.

47. A method of forming a valve from a valve body, a seal, and a valve component, the valve component including a valving member, a retainer, and a frangible portion connecting the valving member to the retainer, the method comprising:

positioning the seal and the valve component in the valve body so that the seal is between the valve component and an end portion of the valve body;

applying force to the valve component sufficient to break the frangible portion and thereby separate the valving member and the retainer; and moving the retainer to a position in which the retainer retains the seal on the end portion of the valve body.

48. The method of claim 47, wherein the applying of force to the valve component includes applying force to the retainer.

49. The method of claim 47, wherein the applying of force to the valve component includes pressing the valve component with an insertion tool.

50. The method of claim 47, further comprising positioning a biasing member in the valve body so that the biasing member biases the valving member toward the end portion of the valve body.

51. The method of claim 47, wherein the retainer and the valve body are cylindrical shaped, the retainer having an outer diameter of approximately the same size as an inner diameter of the valve body, and wherein the moving of the retainer includes force fitting the retainer in the valve body.

52. A valve manufactured by the method of claim 47.

53. A dispenser comprising:

a reservoir; and the valve of claim 52 positioned on the reservoir, the valve selectively allowing at least one of flow of fluid into the reservoir and flow of fluid from the reservoir.

* * * * *

UNITED STATES PATENT AND TRADEMARK OFFICE

CERTIFICATE OF CORRECTION

PATENT NO. : 6,196,276 B1
DATED : March 6, 2001
INVENTOR(S) : Vincent de Laforcade It is certified that error appears in the above-identified patent and that said Letters Patent is hereby corrected as shown below:

Title page,
Item (75), in the Inventor,
Line 1, "De Laforcade" should read -- de Laforcade --.

Claim 1, column 12,
Line 11, after "is" insert -- in --.

Claim 23, column 13,
Line 40, "claim 21" should read -- claim 22 --.

Signed and Sealed this

Eleventh Day of September, 2001

Nicholas P. Godici

*Attest:*

*Attesting Officer*

NICHOLAS P. GODICI
*Acting Director of the United States Patent and Trademark Office*